US008757403B2

(12) United States Patent
Yoshida et al.

(10) Patent No.: US 8,757,403 B2
(45) Date of Patent: Jun. 24, 2014

(54) CAR EQUIPMENT PROTECTION STRUCTURE FOR RAILCAR

(75) Inventors: Naohiro Yoshida, Kobe (JP); Toshiyuki Fujimoto, Kobe (JP); Naoaki Kawakami, Kobe (JP); Tetsuya Takagaki, Akashi (JP); Hideki Kumamoto, Akashi (JP); Seiichiro Yagi, Akashi (JP); Tomonori Umebayashi, Kobe (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 0 days.

(21) Appl. No.: 13/376,484

(22) PCT Filed: Feb. 8, 2011

(86) PCT No.: PCT/JP2011/000694

§ 371 (c)(1),
(2), (4) Date: Jan. 3, 2012

(87) PCT Pub. No.: WO2011/099268

PCT Pub. Date: Aug. 18, 2011

(65) Prior Publication Data

US 2012/0298609 A1 Nov. 29, 2012

(30) Foreign Application Priority Data

Feb. 9, 2010 (JP) ..... 2010-026203

(51) Int. Cl.
*B61G 7/14* (2006.01)
*B61G 7/10* (2006.01)

(52) U.S. Cl.
USPC ..... 213/50; 213/1 R; 213/58; 105/394

(58) Field of Classification Search
CPC ..... B61G 7/14; B61G 7/10; B61G 9/00; B61G 9/02; B61G 9/04; B61G 11/18
USPC ..... 105/392.5, 394; 213/1 A, 1 R, 7, 10, 13, 213/50, 58, 220
See application file for complete search history.

(56) References Cited

U.S. PATENT DOCUMENTS

| | | | |
|---|---|---|---|
| 4,576,294 | A | 3/1986 | Forster |
| 6,820,759 | B1 | 11/2004 | Schindler et al. |
| 2002/0178967 | A1 | 12/2002 | Heinisch et al. |

FOREIGN PATENT DOCUMENTS

| | | | |
|---|---|---|---|
| DE | 40 06 811 | A1 | 9/1991 |
| DE | 195 02 217 | A1 | 10/1996 |
| EP | 0 608 531 | A1 | 8/1994 |
| EP | 0 952 062 | A1 | 10/1999 |
| FR | 2 531 392 | A1 | 2/1984 |

(Continued)

OTHER PUBLICATIONS

Jan. 16, 2013 Supplementary Search Report issued in European Patent Application No. 11 74 2018.2.

(Continued)

*Primary Examiner* — Mark Le
(74) *Attorney, Agent, or Firm* — Oliff PLC

(57) ABSTRACT

A car includes a car equipment protection structure, The car equipment protection structure includes an underframe, couplers and guide members. Each of the guide members is provided on a railcar inner side of an attached flange portion of the underframe to which the couplers are attached. Moreover, the guide members respectively include inclined surfaces, each of which is opposed to at least a part of the coupler. Each of the inclined surfaces is inclined toward the railcar inner side as it extends downward.

9 Claims, 16 Drawing Sheets

(56) References Cited

FOREIGN PATENT DOCUMENTS

| | | |
|---|---|---|
| FR | 2 879 549 A1 | 6/2006 |
| JP | U-62-56368 | 4/1987 |
| JP | A-11-020695 | 1/1999 |
| JP | A-2000-313334 | 11/2000 |
| JP | A-2001-260881 | 9/2001 |
| JP | A-2003-137095 | 5/2003 |
| JP | A-2004-268694 | 9/2004 |
| JP | A-2004-331074 | 11/2004 |
| JP | A-2005-081942 | 3/2005 |
| JP | A-2008-254542 | 10/2008 |
| WO | WO 02/096734 A1 | 12/2002 |

OTHER PUBLICATIONS

International Search Report dated Apr. 19, 2011 issued in PCT/JP2011/000694.

CAR EQUIPMENT PROTECTION STRUCTURE FOR RAILCAR

TECHNICAL FIELD

The present invention relates to a car equipment protection structure for a railcar, the car equipment protection structure being configured to protect car equipment, such as underfloor devices, provided under the floor of a carbody.

BACKGROUND ART

A rail train is constituted by coupling a plurality of railcars one another, and each of the railcars is constituted by mounting a carbody on a bogie. For example, as shown in FIGS. 15 and 16, couplers 3A and 3B for the coupling with the other car are provided on an underframe 2 positioned at a bottom portion of the carbody. As in PTLs 1 and 2 for example, each of the couplers 3A and 3B includes a structure for absorbing a collision load (impact energy) at the time of collision.

The coupler 3A shown in FIG. 15 is provided at a head portion of a first car and is configured to couple the first cars each other. The coupler 3A is an automatic tight lock coupler (for example, Scharfenberg coupler of Germany) including a cylinder mechanism 4A and an impact absorbing pipe 5A. A coupling mechanism 6A for the coupling with the other car is attached to a tip end portion of the cylinder mechanism 4A, and the impact absorbing pipe 5A is attached to a base end portion of the cylinder mechanism 4A. The cylinder mechanism 4A and the impact absorbing pipe 5A absorb an impact load by two-step contraction (or deformation).

The coupler 3A configured as above includes an attachment flange 7A between the cylinder mechanism 4A and the impact absorbing pipe 5A. The attachment flange 7A is fastened and attached to an attached flange portion 8A of the underframe 2 by coupler attachment bolts 9A. An underfloor device 10A is provided behind the coupler 3A. Examples of the underfloor device 10A are a junction box, a bogie, and the like. The junction box is a protection box for electrical devices, air pipes, and contacts and terminals used to couple, branch, or relay electric wires.

The coupler 3B shown in FIG. 16 is provided at a tail portion of the first car and is configured to couple the first car and a middle car. The coupler 3B includes the same components as the coupler 3A (for example, a cylinder mechanism 4B and a coupling mechanism 6B) but is different from the coupler 3A in that an impact absorbing cushion member 5B is included. The impact absorbing cushion member 5B includes an elastic member, such as rubber. At the time of collision, the impact absorbing cushion member 5B fulfills the same function as the impact absorbing pipe 5A used in the first car. As with the coupler 3A, the coupler 3B configured as above includes an attachment flange 7B. The coupler 3B is attached to the underframe 2 such that the attachment flange 7B is fastened to an attached flange portion 8B of the underframe 2 by coupler attachment bolts 9B. An underfloor device 10B is provided in front of the coupler 3B.

The railcar absorbs the impact of the collision by the couplers 3A and 3B. However, the amount of energy the cylinder mechanisms 4A and 4B, the impact absorbing pipe 5A, and the impact absorbing cushion member SB can absorb has an acceptable limit. If the load applied to the couplers 3A and 38 exceeds the acceptable limit, the coupler attachment bolts 9A and 9B break, and the couplers 3A and 3B are separated from the attached flange portions 8. By this separation, excessive reaction force is prevented from being applied to the carbody.

CITATION LIST

Patent Literature

PTL 1: Japanese Laid-Open Patent Application Publication No. 2000-313334

PTL 2: Japanese Laid-Open Patent Application Publication No. 2003-137095

SUMMARY OF INVENTION

Technical Problem

As described in European Standard EN 15227 "Railway applications—Crashworthiness requirements for railway vehicle bodies" in 2008, it is preferable that each of the railcars have a structure in which when the railcars receive the impact of the collision, the carbodies are caused to contact each other, the head portions of the carbodies are caused to be deformed, and kinetic energy of the collision is caused to be absorbed by the deformation of the carbodies.

However, in a case where the coupler attachment bolts 9A and 9B break and the couplers 3A and 3B are separated at the time of collision, the head portions of the cars deform, and the separated couplers 3A and 3B may contact the car equipment, such as the underfloor device 10A or 10B, positioned behind the coupler 3A or 3B. If the couplers 3A and 3B have contacted the car equipment, the couplers 3A and 3B need to be removed from the car equipment in the recovery work after the collision, and the recovery work after the collision requires time. Moreover, if the couplers 3A and 3B have contacted the car equipment, it becomes difficult to absorb, at the time of collision, the kinetic energy by the deformation of the head portion of the carbody based on design assumption. In the case of the head portion of a high-speed railcar having a streamline shape, the coupler may be provided above the underframe. In this case, not the underfloor device but a driver's cab related device is provided behind the coupler, and the driver's cab related device that is the car equipment needs to be protected.

Here, an object of the present invention is to provide a car equipment protection structure for a railcar, the car equipment protection structure being configured to protect the car equipment by preventing the coupler, separated from the underframe at the time of collision, from contacting the car equipment.

Solution To Problem

A car equipment protection structure for a railcar according to the present invention includes: an underframe; an attached portion provided at a front-rear-direction end portion of the underframe; a coupler attached to the attached portion and configured to be able to be coupled to another railcar; a coupler guide member provided on a railcar inner side of the attached portion and including an inclined surface opposed to at least a part of the coupler; and railcar equipment provided on the railcar inner side of the coupler guide member, wherein when the coupler is separated from the attached portion, the coupler guide member guides the coupler upward or downward by the inclined surface to cause the coupler to avoid the equipment.

According to the present invention, even if the coupler is detached and separated from the underframe, falls, and moves toward the car equipment, the coupler hits the coupler guide member, and the coupler guide member can guide the coupler along the inclined surface to cause the coupler to avoid the ear equipment. With this, it is possible to cause the coupler to avoid contact with the car equipment after the collision, and thus the car equipment can be protected.

Advantageous Effects of Invention

According to the present invention, it is possible to cause the coupler, having been separated and fallen from the underframe at the time of collision, to avoid contact with the car equipment, and thus the ear equipment can be protected.

DESCRIPTION OF EMBODIMENTS

Hereinafter, car equipment protection structures (hereinafter may be simply referred to as "protection structures") 11, 11A, and 11B for a railcar according to embodiments of the present invention will be explained in reference to the drawings. A concept of directions in respective embodiments corresponds to a concept of directions when a running direction of the railcar (hereinafter may be simply referred to as "car") is defined as a front direction. In a car longitudinal direction (front-rear direction), an outside of the car from an end portion of an underframe 15 is referred to as an "outer side", and an inside (bogie side) of the car from the end portion of the underframe 15 is referred to as an "inner side". The protection structure 11 for the railcar explained below is just one embodiment of the present invention. To be specific, the present invention is not limited to the embodiments below, and additions, eliminations, and modifications may be made within the spirit of the present invention.

Embodiment 1

The car is configured to be able to be coupled to another car, and a rail train is constituted by coupling a plurality of cars in series. As the car, there are a first car positioned mainly at the head or tail of the rail train and a middle car positioned between the car at the head and the car at the tail. Regarding the railcar, the car positioned at the tail in an outward route is positioned at the head in a return route. Therefore, a first car 12 is also used as the car positioned at the tail. The arrangement of the first car 12 at the tail is opposite to the arrangement of the first car 12 at the head in the front-rear direction. Hereinafter, among these cars, the configuration of the first car 12 at the head of the rail train will be explained in reference to FIGS. 1 to 8.

Car

Figure 1:
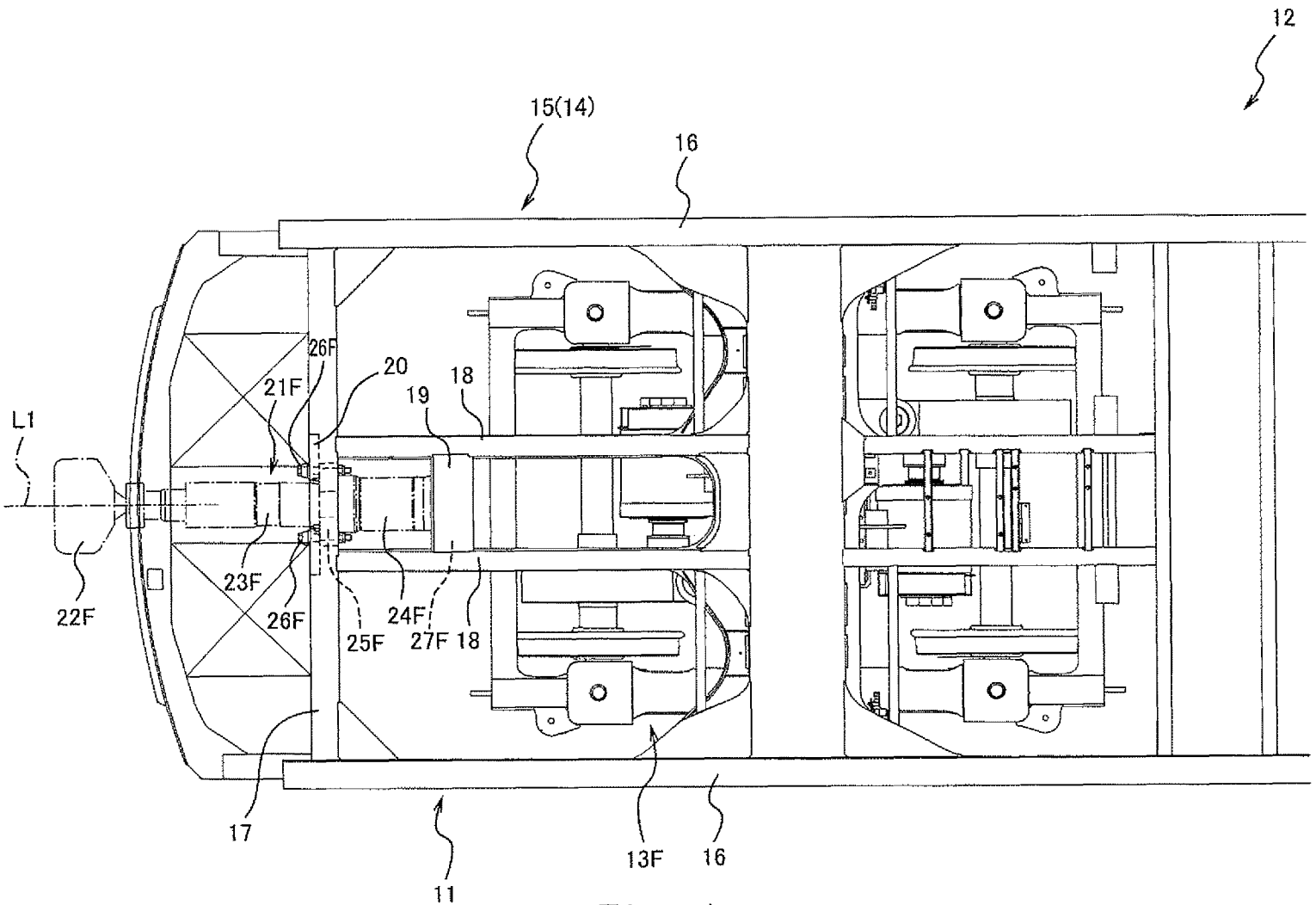
FIG. 1 is a plan view showing a head portion of a first car including a car equipment protection structure according to Embodiment 1 of the present invention when viewed from above (carbody components other than an underframe are not shown).
Figure 2:
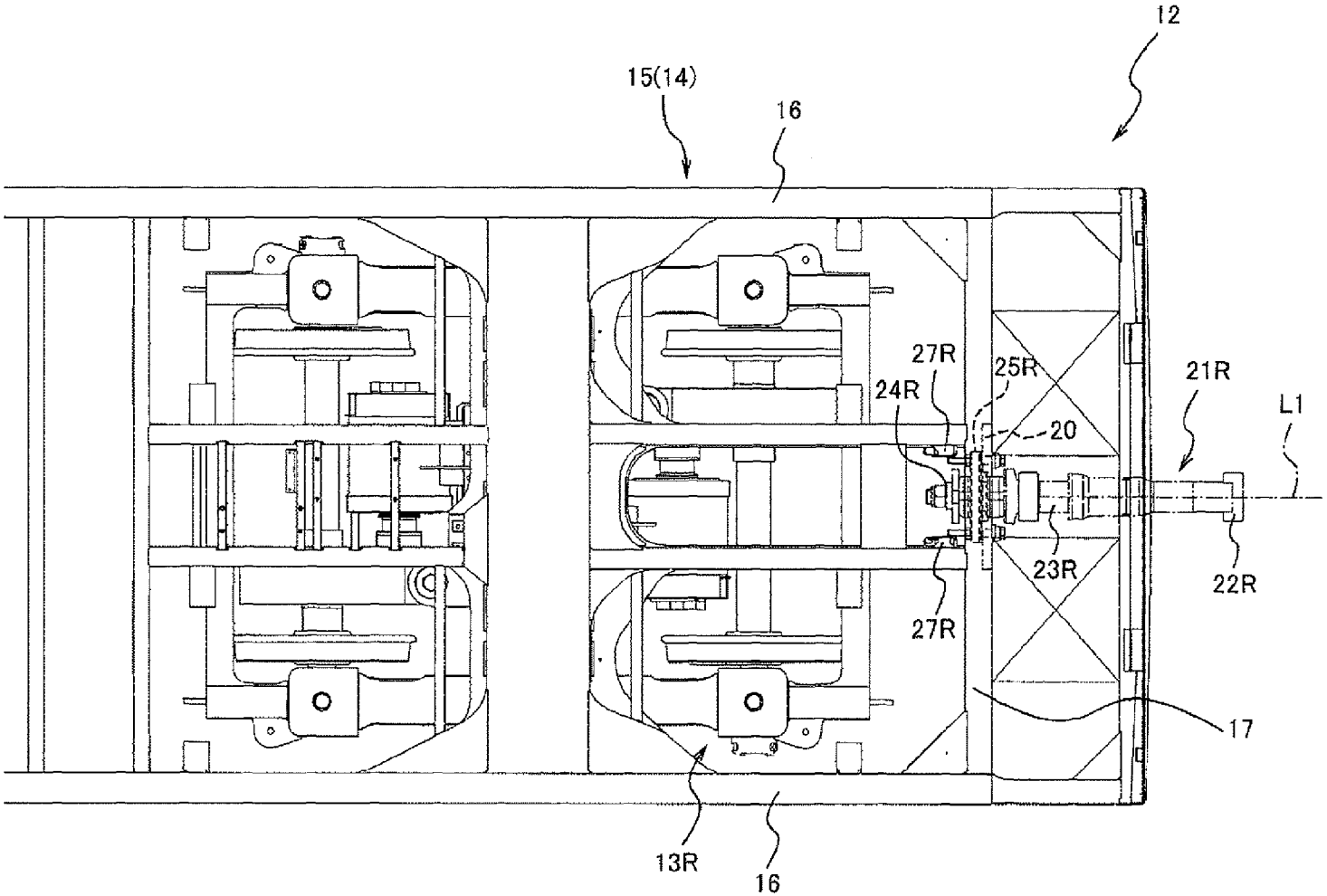
FIG. 2 is a plan view showing a tail portion of the first car shown in FIG. 1 when viewed from above (carbody components other than the underframe are not shown).

As shown in FIGS. 1 and 2, the first car 12 includes two bogies 13F and 13R and a bodyshell 14. The bogies 13F and 13R are configured to be able to run on track and are positioned to be spaced apart from each other in the front-rear direction that is the running direction. The bodyshell 14 is mounted on these two bogies 13F and 13R (see FIGS. 3 and 6) via air springs, not shown. The bodyshell 14 has a substantially hollow rectangular solid shape, that is, a box shape, and a space for accommodating passengers or cargoes is formed in the bodyshell 14. A head portion 14*a* and tail portion 14*b* of the bodyshell 14 of the first car 12 are so-called collapse zones and deform to absorb a collision load at the time of collision. Therefore, by the collapse of the collapse zone of the first car 12 which has received the impact, the deformation of the space for accommodating passengers or cargoes is suppressed at the time of collision, and a survival zone can be secured as widely as possible.

Car equipment, such as below-described underfloor devices 40F and 40R, are provided under the bodyshell 14, and the first car 12 includes the car equipment protection structure 11 configured to protect the car equipment. The car equipment protection structure 11 basically includes the underframe 15, couplers 21F and 21R, and guide members 27F and 28R. The underframe 15 constitutes a bottom portion of the bodyshell 14.

Underframe

As shown in FIGS. 1 and 2, the underframe 15 has a substantially rectangular shape in plan view by side sills 16 and cross beams 17. The side sills 16 respectively form left and right end portions of the underframe 15. Each of the cross beams 17 extends in a car width direction to connect the side sills 16. Each of a pair of center sills 18 extends to connect the cross beams 17. The pair of center sills 18 extend in parallel with the front-rear direction, are positioned at a center portion of the underframe 15 in the car width direction (that is, a left-right direction), and are respectively positioned on left and right sides of a center line L1 of the first car 12.

Each of bridge members 19 extend in the car width direction to connect the pair of center sills 18. One of the bridge members 19 is provided on the front side, and the other bridge member 19 is provided on the rear side. Further, a front end portion and rear end portion of each of the pair of center sills 18 project downward as compared to the other portion of each of the pair of center sills 18. An attached flange portion 20 extends to connect the front end portions of the pair of center sills 18 each other, and another attached flange portion 20 extends to connect the rear end portions of the pair of center sills 18 each other. Each of the attached flange portions 20 is a plate-shaped member having a U shape when viewed from the front, and an opening of a through hole 20*a* formed at a center portion of the attached flange portion 20 is open downward (see FIGS. 4, 5, 7, and 8). An axis line of the through hole 20*a* substantially coincides with an axis line L1 in plan view, and the through hole 20*a* communicates with a space between the pair of center sills 18. The couplers 21F and 21R are respectively inserted through the through holes 20*a*. The couplers 21F and 21R are respectively attached to the attached flange portions 20 positioned on the front and rear sides such that a part of each of the couplers 21F and 21R is positioned between the pair of center sills 18.

Hereinafter, first, the configuration of the head-side coupler 21F provided at the head portion of the first car 12 will be explained. Then, the tail-side coupler 21R provided at the tail portion of the first car 12 will be explained.

Head-Side Coupler

Figure 3:
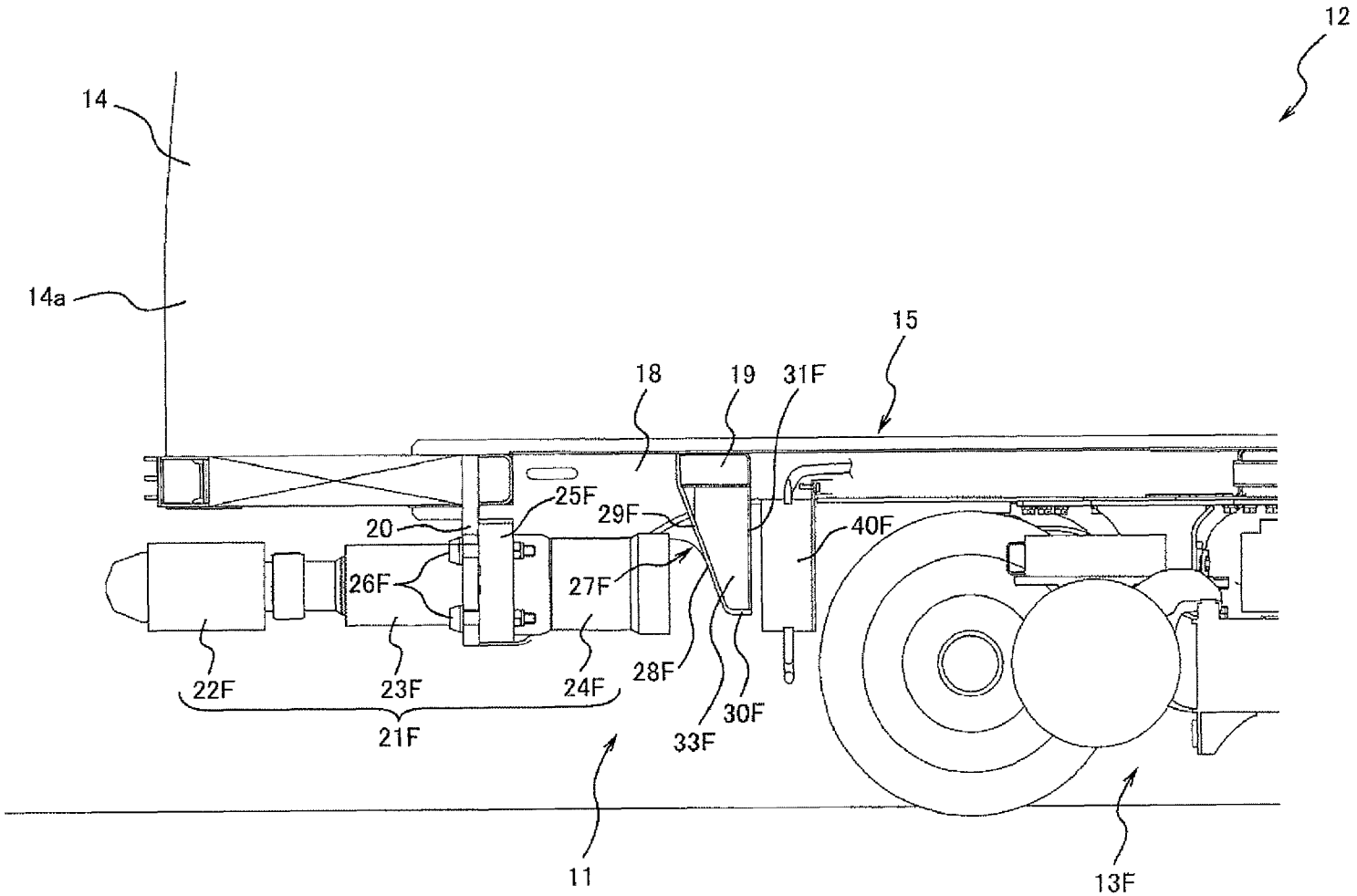
FIG. 3 is a side view showing the head portion of the first car shown in FIG. 1 when viewed from one side.

As shown in FIGS. 1 and 3, the head-side coupler 21F is attached to the attached flange portion 20 positioned on the front side. The head-side coupler 21F includes a coupling mechanism 22F, a cylinder mechanism 23F, and an impact absorbing pipe 24F. The coupling mechanism 22F is configured to be able to be coupled to the coupling mechanism 22F of the other first car for the coupling with the other first car. The coupling mechanism 22F is provided at a tip end portion (front end portion) of the cylinder mechanism 23F. The cylinder mechanism 23F is a so-called oil hydraulic cylinder or air cylinder. When the cylinder mechanism 23F receives the collision load, it contracts and absorbs the collision load (impact energy). The impact absorbing pipe 24F is provided at a base end portion (rear end portion) of the cylinder mechanism 23F. The impact absorbing pipe 24F that is an impact absorbing member is configured to be able to contract or deform. By the contraction or the deformation, the impact absorbing pipe 24F absorbs the collision load which cannot be received by the cylinder mechanism 23F. The impact absorbing pipe 24F is provided in series with the cylinder mechanism 23F in the front-rear direction, and an attachment flange portion 25F is provided between the cylinder mechanism 23F and the impact absorbing pipe 24F.

In the present embodiment, when the cylinder mechanism cannot receive the entire collision load, the impact absorbing pipe can contract or deform. However, the present embodiment is not limited to this. For example, the cylinder mechanism and the impact absorbing pipe may be configured such that the cylinder mechanism receives the collision load, and at the same time, the impact absorbing pipe receives the collision load. The cylinder mechanism and the impact absorbing pipe may have any configuration as long as they can adequately receive the collision load.

An outer shape of the attachment flange portion 25F is a rectangular shape when viewed from the front. The attachment flange portion 25F is inserted between the pair of center sills 18. The attachment flange portion 25F is provided on a rear side (bogie 13F side) of the attached flange portion 20, and coupler attachment bolts 26F are provided at four corners of the attachment flange portion 25F. By these four coupler attachment bolts 26F, the attachment flange portion 25F is fastened and attached to the attached flange portion 20. Examples of the coupler attachment bolts 26F are hexagon headed bolts and reamer bolts. By the above attachment, the coupling mechanism 22F projects from the head portion of the first car 12, and the impact absorbing pipe 24F projects from the cross beam 17 toward the bogie 13F side. Between the attachment flange portion 25F and the bogie 13F, the underfloor device 40F and the head-side guide member 27F are provided in this order from the bogie 13F side.

Car Equipment

Examples of the underfloor device 40F are a junction box, devices provided under the underframe 15 and on the bogie 13F, and the bogies 13F and 13R. The junction box is a protection box for electrical devices, air pipes, and contacts and terminals used to couple, branch, or relay electric wires. These car equipment are positioned on a car inner side (bogie 13F side) of the head-side coupler 21F and the below-described head-side guide member 27F, and the head-side guide member 27F is provided on the underframe 15 to protect the car equipment from the head-side coupler 21F.

Head-Side Guide Member

Figure 4:
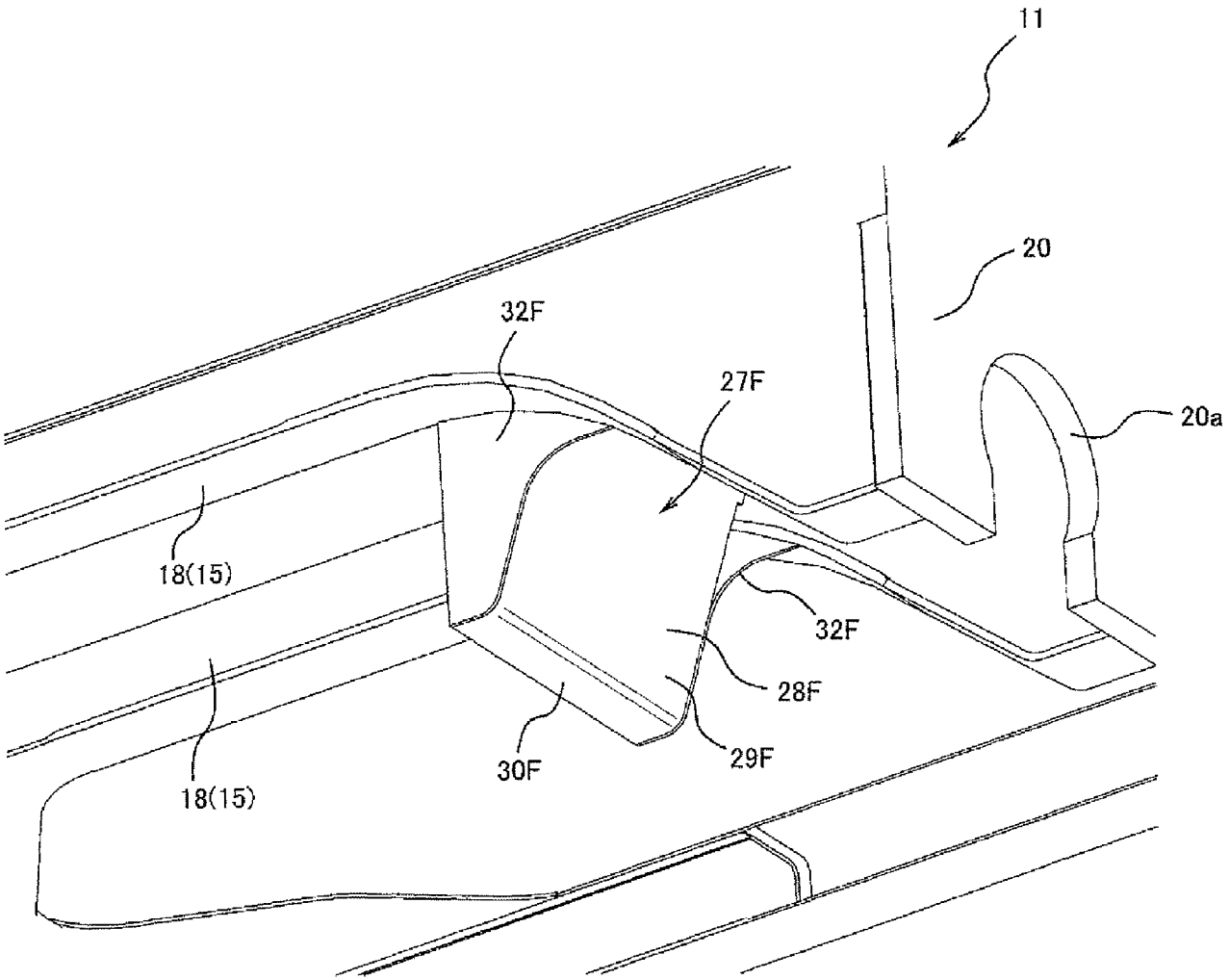
FIG. 4 is a perspective view showing the head portion of the first car shown in FIG. 3 when viewed from obliquely below.
Figure 5:
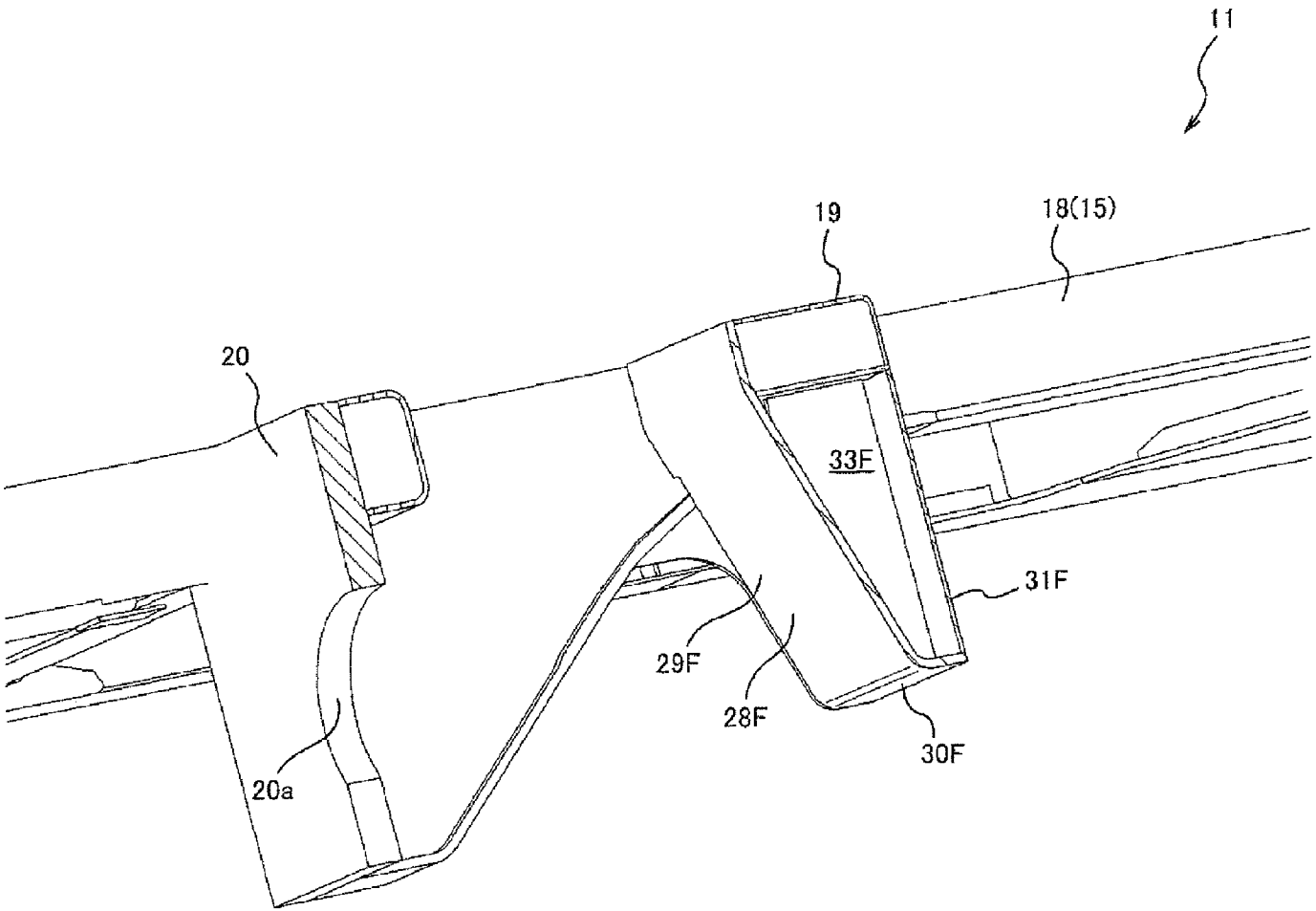
FIG. 5 is a perspective cross-sectional view showing the head portion of the first car shown in FIG. 4, a part of the head portion being cut.

As shown in FIGS. 4 and 5, the head-side guide member 27F that is a coupler guide member is a box-shaped member extending in the car width direction and is formed integrally with the bridge member 19. The head-side guide member 27F includes a front plate 29F, a lower plate 30F, a reinforcing plate 31F, and a pair of side plates 32F. The front plate 29F that is a guide plate portion is a plate-shaped member extending in the car width direction and the vertical direction. The front plate 29F is formed integrally with a lower surface of the bridge member 19 so as to be opposed to a base end portion (rear end portion) of the head-side coupler 21F. The front plate 29F is provided to connect the pair of center sills 18 and includes an inclined surface 28F on the entire front surface. The inclined surface 28F is opposed to the rear end portion of the head-side coupler 21F and is inclined so as to avoid the car equipment. In the present embodiment, the inclined surface 28F is inclined toward the bogie 13F as it extends downward. A lower end of the inclined surface 28F, that is, a lower end of the front plate 29F is lower than lower ends of the pair of center sills 18, and the lower plate 30F is formed integrally with the lower end of the front plate 29F.

The lower plate 30F extends horizontally from the lower end of the front plate 29F to the bogie 13F side, and the reinforcing plate 31F is provided at a rear end portion of the lower plate 30F. The reinforcing plate 31F is a flat plate-shaped member and extends upward from the lower plate 30F. An upper end of the reinforcing plate 31F contacts a lower surface of the bridge member 19, and the reinforcing plate 31F covers an entire rear surface of the front plate 29F. The side plates 32F are respectively provided on left and right side surfaces of the front plate 29F.

The side plates 32F are formed to correspond to the shapes of openings surrounded by the pair of center sills 18, the front plate 29F, the lower plate 30F, and the reinforcing plate 31F and positioned on both left and right sides. The side plates 32F are attached to the upper surfaces of the pair of center sills 18 and the side surfaces of the front plate 29F, the lower plate 30F, and the reinforcing plate 31F so as to close the openings. By the side plates 32F, the head-side guide member 27F is configured as a box having a space behind the inclined surface 28F, that is, having a closed cross section structure.

As above, the head-side guide member 27F is attached to the pair of center sills 18 having high stiffness via the bridge member 19. With this, even if the head-side coupler 21F is detached from the underframe 15 at the time of collision and hits the head-side guide member 27F, the amount of deformation of the underframe 15 can be suppressed. In addition, by configuring the box-shaped head-side guide member 27F having the closed cross section structure, the stiffness and strength of the head-side guide member 27F can be improved. To further improve the stiffness and strength of the head-side guide member 27F, a pair of reinforcing members 33F are provided in an internal space of the head-side guide member 27F in parallel with each other in the car width direction so as to extend in the vertical direction. Each of the reinforcing members 33F is formed to correspond to a cross-sectional shape of the internal space of the head-side guide member 27F, the cross-sectional shape being perpendicular to the car width direction.

Tail-Side Coupler

Figure 6:
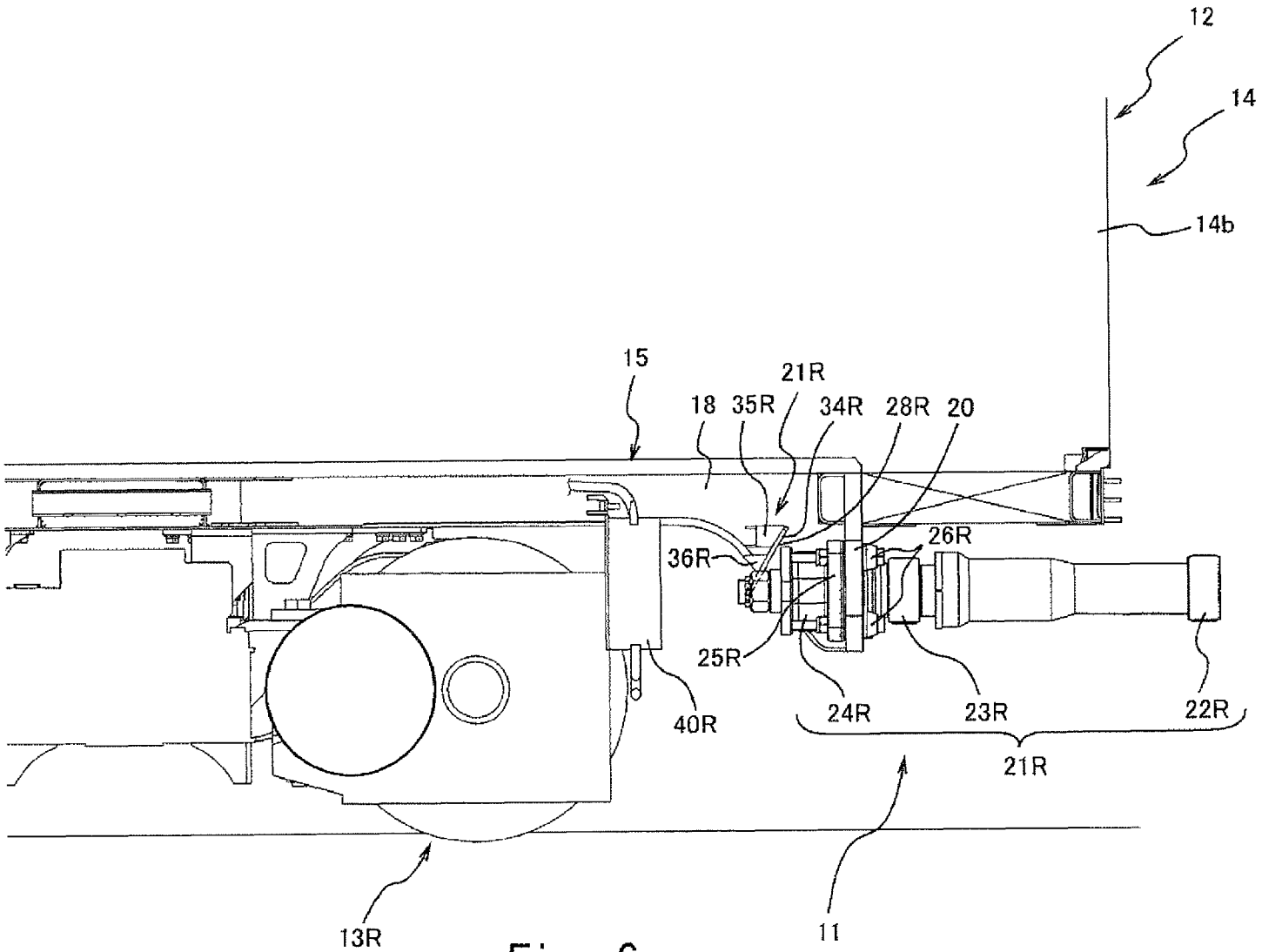
FIG. 6 is a side view showing the tail portion of the first car shown in FIG. 2 when viewed from one side.

As shown in FIGS. 2 and 6, the tail-side coupler 21R is attached to the attached flange portion 20 positioned on the rear side. The tail-side coupler 21R includes a coupling mechanism 22R, a cylinder mechanism 23R, and an impact absorbing cushion member 24R. The coupling mechanism 22R is configured to be able to be coupled to a coupler of the middle car (the coupler of the middle car is not shown but is the same in configuration as the tail-side coupler 21R). The coupling mechanism 22R is provided at a tip end portion (rear end portion) of the cylinder mechanism 23R. The cylinder mechanism 23R is a so-called oil hydraulic cylinder or air cylinder. When the cylinder mechanism 23R receives the collision load, it contracts and absorbs the collision load (impact energy). The impact absorbing cushion member 24R is provided at a base end portion (front end portion) of the cylinder mechanism 23R. The impact absorbing cushion member 24R that is the impact absorbing member includes an elastic member, such as rubber, and is configured to be able to elastically deform. By the elastic deformation, the impact absorbing cushion member 24R absorbs the collision load which cannot be received by the cylinder mechanism 23R. The impact absorbing cushion member 24R is provided in series with the cylinder mechanism 23R in the front-rear direction, and an attachment flange portion 25R is provided between the cylinder mechanism 23R and the impact absorbing cushion member 24R.

An outer shape of the attachment flange portion 25R is a rectangular shape when viewed from the rear. The attachment flange portion 25R is inserted between the pair of center sills 18. The attachment flange portion 25R is provided on a front side (bogie 13R side) of the attached flange portion 20, and coupler attachment bolts 26R are provided at four corners of the attachment flange portion 25R. By these four coupler attachment bolts 26R, the attachment flange portion 25R is fastened and fixed to the attached flange portion 20.

By the above attachment, the coupling mechanism 22R projects from the tail portion of the first car 12, and the impact absorbing cushion member 24R projects from the cross beam 17 toward the bogie 13R side. By using the impact absorbing cushion member 24R, the amount of projection from the cross beam 17 toward the bogie 13R side is smaller than that of the head-side coupler 21F. Therefore, the tail-side coupler 21R is configured to be short.

Between the attachment flange portion 25R and the bogie 13R, the underfloor device 40R and a pair of tail-side guide members 27R are provided in this order from the bogie 13R side. An explanation of the underfloor device 40R is omitted since the underfloor device 40F has been explained above. As above, the car equipment, such as the underfloor device 40R and the bogie 13R, are also provided on the front side (on the bogie 13R side) of the attachment flange portion 25R and the below-described tail-side guide members 27R. To protect these car equipment, the pair of tail-side guide member 27R are provided on the underframe 15. Specifically, the tail-side guide members 27R are respectively provided on inner surfaces (opposed surfaces) of rear end portions of the pair of center sills 18.

Tail-Side Guide Member

Figure 7:
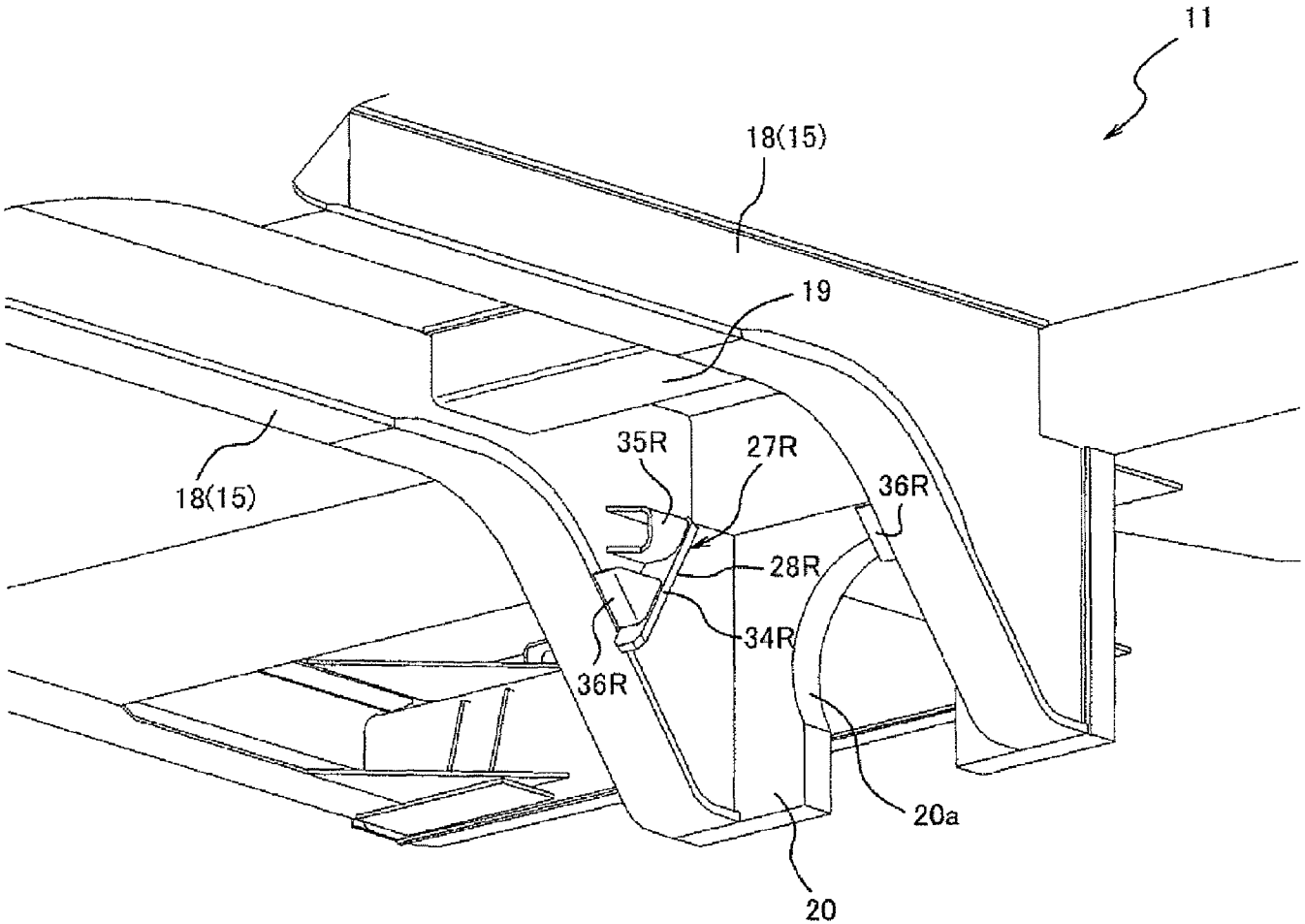
FIG. 7 is a perspective view showing the tail portion of the first car shown in FIG. 6 when viewed from obliquely below.
Figure 8:
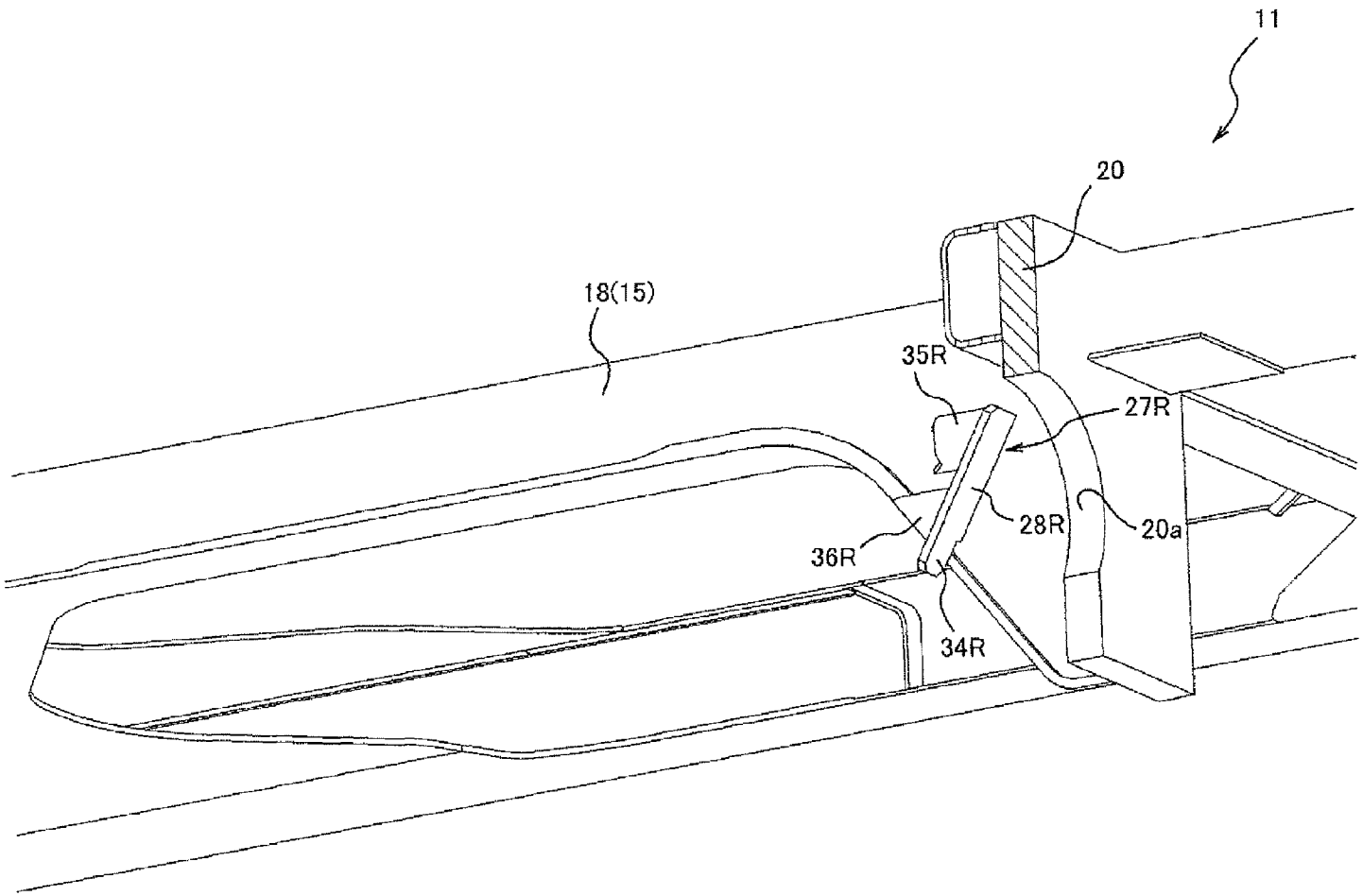
FIG. 8 is a perspective cross-sectional view showing the tail portion of the first car shown in FIG. 7, a part of the tail portion being cut.
Figures 9A, 9B, 9C:
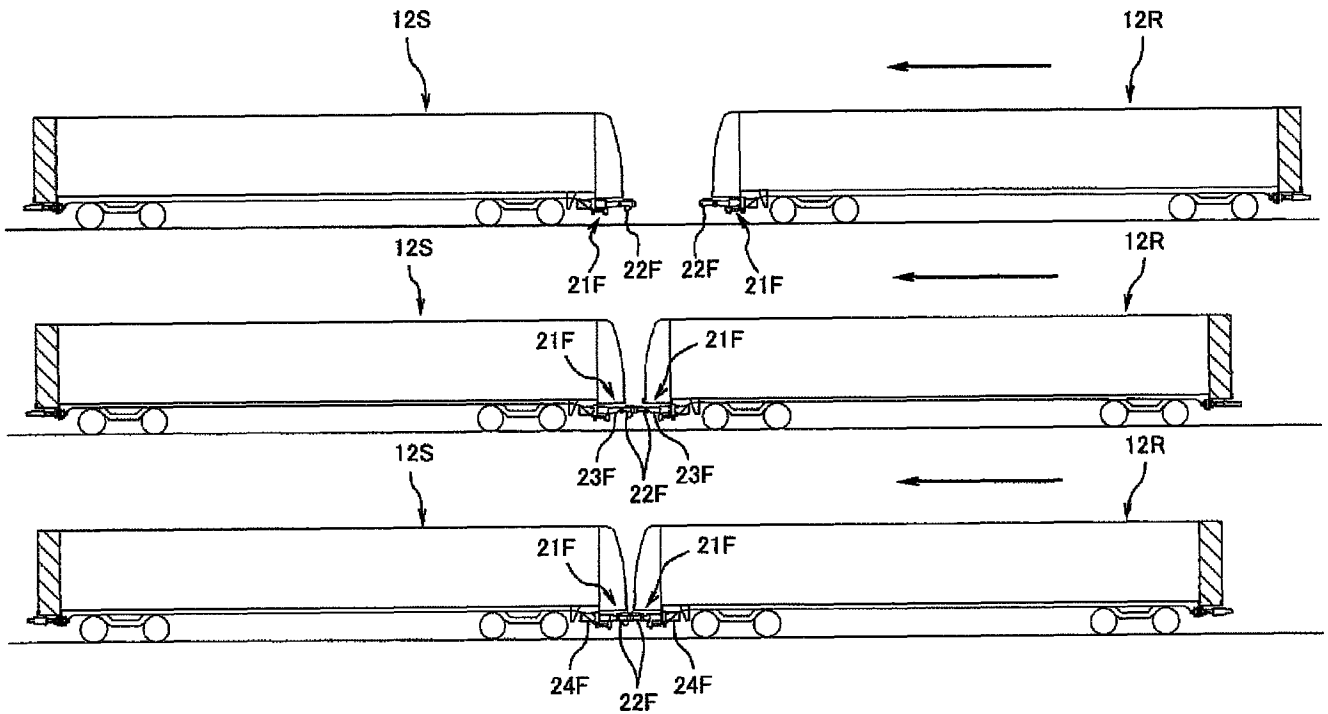
FIGS. 9A to 9C are operation diagrams each showing results of a simulation in which the first cars collide with each other.
Figures 10A, 10B, 10C, 10D:
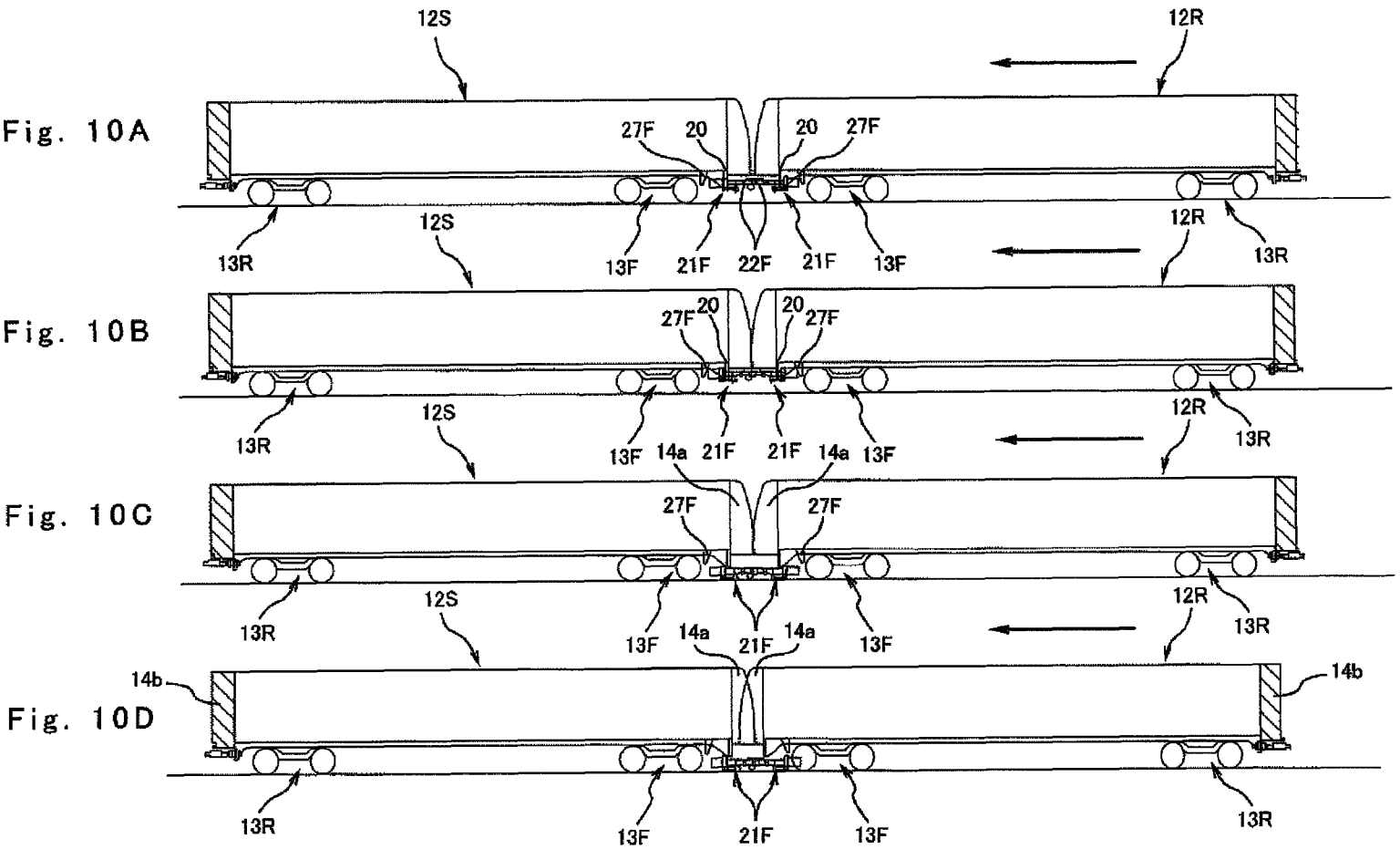
FIGS. 10A to 10D are operation diagram showing the results of the simulation in which the first cars collide with each other.

As shown in FIGS. 7 and 8, each of the pair of tail-side guide members 27R that are the coupler guide members includes a guide plate portion 34R and two supporting members 35R and 36R. The guide plate portion 34R is a strip-shaped plate member extending in an obliquely upper and rear direction and is provided so as to project from the center sill 18 to the inner side. The guide plate portion 34R includes an inclined surface 28R on an entire rear surface thereof. The inclined surfaces 28R of two guide plate portions 34R are respectively opposed to left and right upper corners of the attachment flange portion 25R. The inclined surface 28R is inclined so as to avoid the car equipment. In the present embodiment, the inclined surface 28R is inclined toward the bogie 13R as it extends downward. Two supporting members 35R and 36R are provided on a front surface of the guide plate portion 34R so as to support the guide plate portion 34R and be spaced apart from each other in the vertical direction.

The upper supporting member 35R is formed such that a cross section taken along a virtual flat surface perpendicular to the front-rear direction is a U shape. The upper supporting member 35R is attached to the center sill 18 such that an opening of the U shape is opposed to the center sill 18 so as to be closed by the center sill 18. The lower supporting member 36R is formed such that a cross section taken along a virtual flat surface perpendicular to the front-rear direction is an L shape. The lower supporting member 36R is positioned such that in a state where the lower supporting member 36R is attached to the center sill 18, an opening faces upward.

By the above attachment, the tail-side guide members 27R are respectively attached to the pair of center sills 18 having high stiffness. With this, even if the tail-side coupler 21R is detached from the underframe 15 at the time of collision and hits the tail-side guide members 27R, the amount of deformation of the underframe 15 can be suppressed. Since the tail-side guide members 27R are constituted by plate-shaped members, they can be smaller in weight than the head-side guide member 27F. As with the head-side guide member 27F, the tail-side guide members 27R may be configured as a box shape having the closed cross section structure.

The tail-side coupler 21R and the tail-side guide members 27R are provided as the coupler and the guide members at not only the tail portion of the first car 12 but also each of both front and rear end portions of the middle car. The configurations of the coupler and the guide members provided at the front end portion of the middle car are opposite to the configurations of the tail-side coupler 21R and the tail-side guide members 27R in the front-rear direction.

Movements of Coupler, Etc. At the Time Of Collision

Hereinafter, a simulation in which the stopped first car 12 (hereinafter may be referred to as "stopped car 12S") and the running first car 12 (hereinafter may be referred to as "running car 12R") collide head-on will be explained in reference to FIGS. 9A to 9C and 10A to 10D. According to this simulation, the running car 12R is running on the track toward the stopped car 12S which is in a stopped state on the same track (see FIG. 9A) and collides with the stopped car 12S head-on. In the case of the head-on collision, since the coupling mechanisms 22F of the head-side couplers 21F of the first cars 12S and 12R project from the head portions of the first cars 12S and 12R, the coupling mechanisms 22F collide with each other, and the head-side couplers 21F are compressed (see FIG. 9B). With this, the coupling mechanisms 22F receive the impact load, and the cylinder mechanisms 23F contract so as to absorb the impact load.

The cylinder mechanism 23F can absorb the collision load up to a predetermined acceptable load. However, if the running speed at the time of collision is high, and the impact load exceeds the acceptable load of the cylinder mechanism 23F, the cylinder mechanism 23F completely contracts and acts as one rigid body. After the cylinder mechanism 23F has completely contracted, the impact absorbing pipe 24F contracts and deforms to absorb the collision load (see FIG. 9C). Thus, the head-side coupler 21F absorbs the collision load by the two-step deformation of the cylinder mechanism 23F and the impact absorbing pipe 24F.

However, if the collision load which is equal to or higher than a predetermined acceptable load of the impact absorbing pipe 24F is applied to the impact absorbing pipe 24F, the impact absorbing pipe 24F cannot absorb the collision load any more. In this case, four coupler attachment bolts 26F for fastening the head-side coupler 21F to the attached flange portion 20 receive the collision load. However, four coupler attachment bolts 26F break if they receive a predetermined collision load. Therefore, if the head-side couplers 21F cannot absorb the collision load any more, the coupler attachment bolts 26F of the head-side coupler 21F of at least one of the stopped car 12S and the running car 12R, that is, the coupler attachment bolts 26F of the head-side coupler 21F of the running car 12R in the present embodiment break. Then, the head-side couplers 21F of the running car 12R and the stopped car 12S are separated and fall from the attached flange portion 20 in a state where the head-side couplers 21F are coupled to each other (see FIG. 10A).

Then, the running car 12R further moves toward the stopped car 12S, and thus the fallen head-side coupler 21F relatively moves back toward the bogie 13F of the running car 12R. Finally, the base end portion of the head-side coupler 21F hits the inclined surface 28F of the head-side guide member 27F. With this, the base end portion of the head-side coupler 21F is guided along the inclined surface 28F in a direction to avoid the car equipment, that is, in a downward direction. During this time, since the base end portion of the head-side coupler 21F is being supported by the head-side guide member 27F, large reaction force is applied to four coupler attachment bolts 26F of the head-side coupler 21F of the stopped car 12S. Thus, the coupler attachment bolts 26F of the head-side coupler 21F of the stopped car 12S also break. As with the running car 12R, after the coupler attachment bolts 26F of the head-side coupler 21F of the stopped car 12S break, the head-side coupler 21F relatively moves back toward the bogie 13F and hits the inclined surface 28F (see FIG. 10B), and the base end portion thereof is guided along the inclined surface 28F in the downward direction. With this, after two head-side couplers 21F are separated from the coupler bolts 26F, the head-side couplers 21F can be caused to fall by the inclined surfaces 28F (see FIG. 10C). Thus, two head-side couplers 21F can be prevented from contacting the ear equipment, such as the underfloor device 40F.

After two head-side couplers 21F have fallen substantially directly below, the head portions 14*a* of the bodyshells 14 of the running car 12R and the stopped car 12S collide with each other. By this collision, the head portions 14*a* deform (see FIG. 10D). By this deformation of the head portions 14*a*, the collision load (impact energy) can be absorbed, and the survival zone can be secured. As above, by causing the head-side couplers 21F to fall substantially directly below, the absorption of the impact energy by the deformation of the head portions 14*a* can be caused quickly. Thus, the survival zone can be secured adequately. In addition, by causing two head-side couplers 21F to fall substantially directly below, the recovery work after the collision becomes easy, and the work time can be shortened.

In FIGS. 10A to 10D, the head-side couplers 21F of the running car 12R and the stopped car 12S are coupled to each other. However, the present embodiment is not limited to this. For example, the head-side couplers 21F of the running car 12R and the stopped car 12S may be independently separated and fall substantially directly below.

Next, the movements of the couplers of the first car and the middle car when the collision load is applied will be explained. In the rail train, when the first cars 12 collide with each other as described above, the collision load is transmitted to the following cars via the bodyshell 14 of the first car 12 such that the collision load is absorbed by not only the first cars 12 but also the entire train. Therefore, the collision load is also applied to the tail-side coupler 21R of the first car 12 and the coupler (not shown) of the middle car coupled to the tail-side coupler 21R of the first car 12. As with the head-side coupler 21F, each of the tail-side coupler 21R and the coupler which have received the collision load absorbs the collision load by the two-step deformation of the cylinder mechanism 23R and the impact absorbing cushion member 24R. If the collision load is not entirely absorbed, the coupler attachment bolts 26R break, and at least one of the tail-side coupler 21R and the coupler falls from the underframe 15.

For example, if the tail-side coupler 21R falls, it relatively moves toward the bogie 13R, and the base end portion of the tail-side coupler 21R finally hits the inclined surface 28R of the tail-side guide member 27R. After this hit, the tail-side coupler 21R is guided along the inclined surface 28R in a direction to avoid the underfloor device 40R, that is, in the downward direction in the present embodiment. During this time, since the base end portion of the tail-side coupler 21R is being supported by the tail-side guide member 27R, large reaction force is applied to the coupler. Thus, the coupler attachment bolts (not shown) of the coupler break. With this, the coupler also falls and moves toward the guide member (not shown). Finally, the coupler hits the inclined surface of the guide member and is guided in the downward direction. With this, the tail-side coupler 21R and the coupler can be caused to fall substantially directly below, and the tail-side coupler 21R and the coupler can be prevented from contacting the car equipment, such as the underfloor device 40R.

After the tail-side coupler 21R and the coupler have fallen substantially directly below, the tail portion 14*b* of the first car 12 and the head portion of the middle car collide with each other, and respective portions deform by this collision. By this deformation, the collision load (impact energy) is absorbed, and the survival zone can be secured. By causing the tail-side coupler 21R and the coupler to fall substantially directly below, the absorption of the impact energy by the deformation of the tail portion 14*b* of the first ear 12 and the head portion of the middle car can be caused quickly. Thus, the survival zone can be secured adequately.

As with the above, regarding the middle cars, the collision load (impact energy) is absorbed by the couplers, and the couplers are caused to fall substantially directly below by the guide members. With this, the car equipment, such as the underfloor device, provided under the floor of the middle car can be protected.

Embodiment 2

A car equipment protection structure 11A according to Embodiment 2 of the present invention is similar in configuration to the car equipment protection structure 11 according to Embodiment 1 of the present invention. Hereinafter, regarding the car equipment protection structure 11A according to Embodiment 2, only the components different from the components of the car equipment protection structure 11 according to Embodiment 1 will be explained, and explanations of the same components are omitted.

Figure 11:
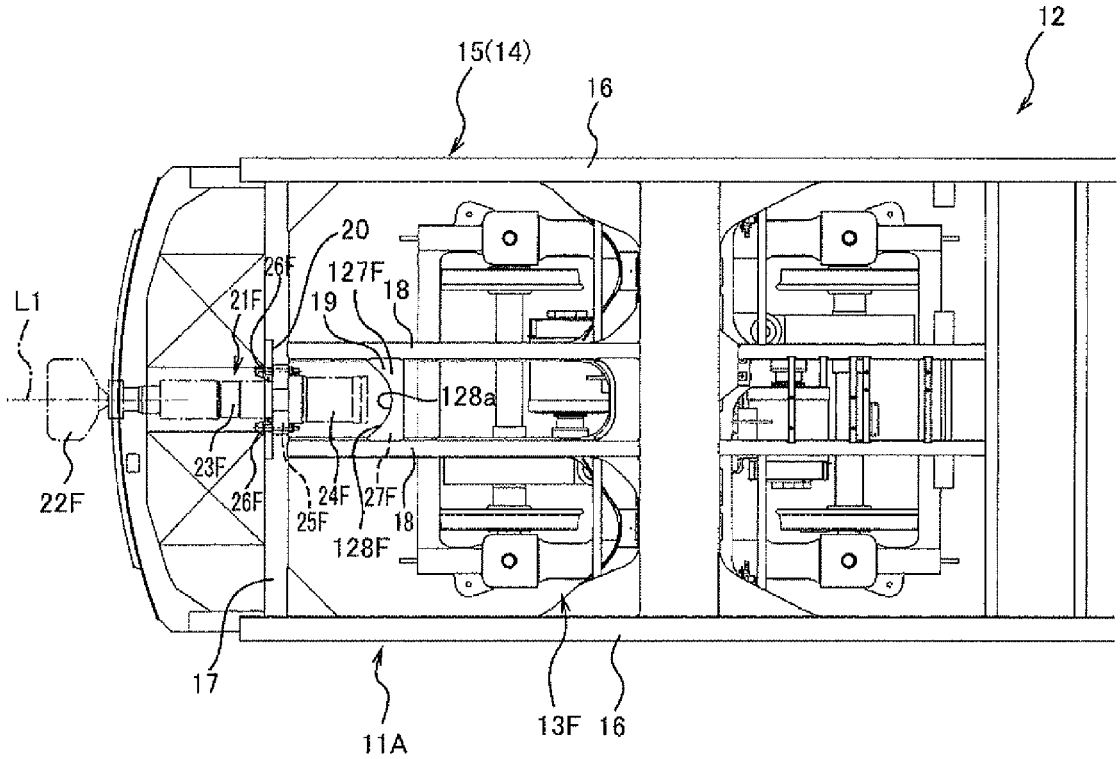
FIG. 11 is a plan view showing the head portion of the first car including the car equipment protection structure according to Embodiment 2 of the present invention when viewed from above (carbody components other than the underframe are not shown).

As shown in FIG. 11, in the car equipment protection structure 11A according to Embodiment 2, an inclined surface 128F of a head-side guide member 127F includes a concave portion 128*a*. A car-width-direction center portion of the concave portion 128*a* is concave toward the bogie 13F in plan view, and each of both car-width-direction side portions thereof is inclined, that is, curved toward the center portion. By this curve, the head-side guide member 127F obtains a centering function of guiding to the car-width-direction center portion the head-side coupler 21F which has separated from the underframe 15, fallen, and hit the inclined surface 128F. With this, the fallen head-side coupler 21F can be prevented from moving in the car width direction and being separated from the inclined surface 128F. Thus, the head-side coupler 21F can be caused to fall in the vicinity of substantially directly below the car-width-direction center.

Other than the above, the car equipment protection structure 11A according to Embodiment 2 have the same operational advantages as the car equipment protection structure 11 of Embodiment 1.

Figure 12:
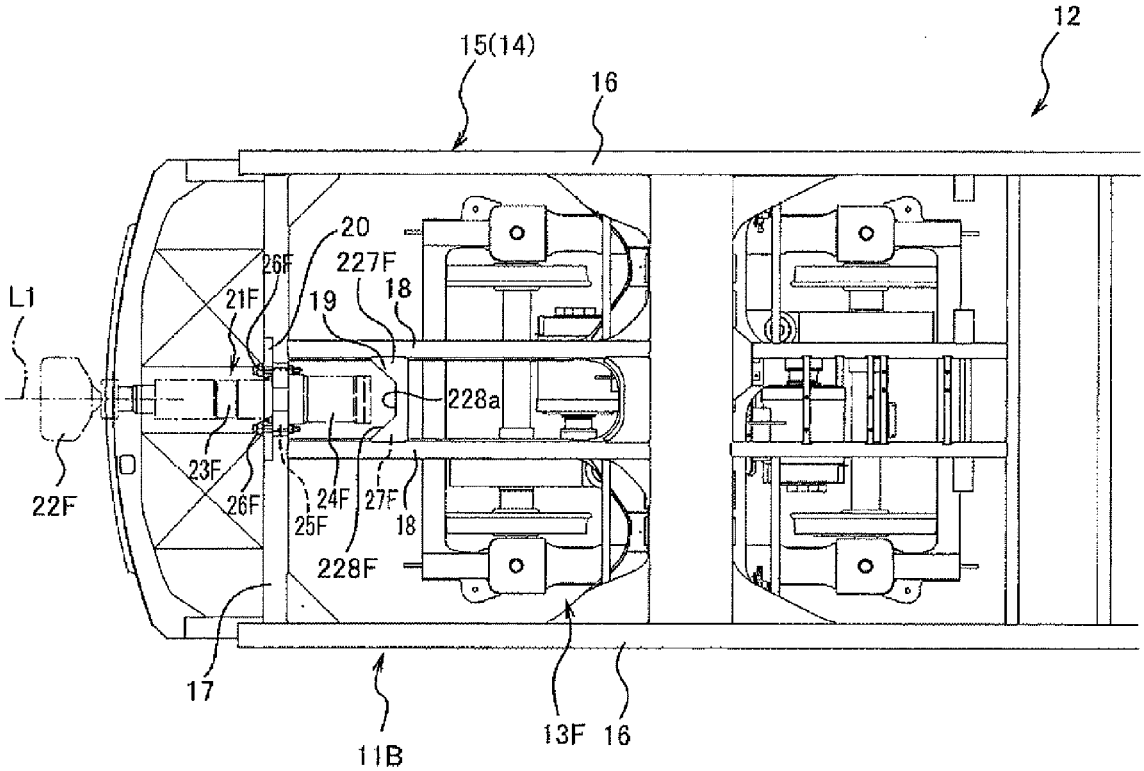
FIG. 12 is a plan view showing the head portion of the first car including the car equipment protection structure according to an embodiment different from Embodiment 2 of the present invention when viewed from above (carbody components other than the underframe are not shown).

In the head-side guide member 127F according to Embodiment 2, the concave portion 128*a* of the inclined surface 128F is curved. However, as shown by a car equipment protection structure 11B in FIG. 12, a concave portion 228*a* of an inclined surface 228F of a head-side guide member 227F may be formed in a tapered shape. That is, each of both left and right car-width-direction end portions of the inclined surface 228F is inclined toward the bogie 13F as it extends toward the car-width-direction center portion. By forming the inclined surface 228F in this shape, the inclined surface 228F obtains the centering function and the same operational advantages as the inclined surface 128F.

Other Embodiment

Figure 13:
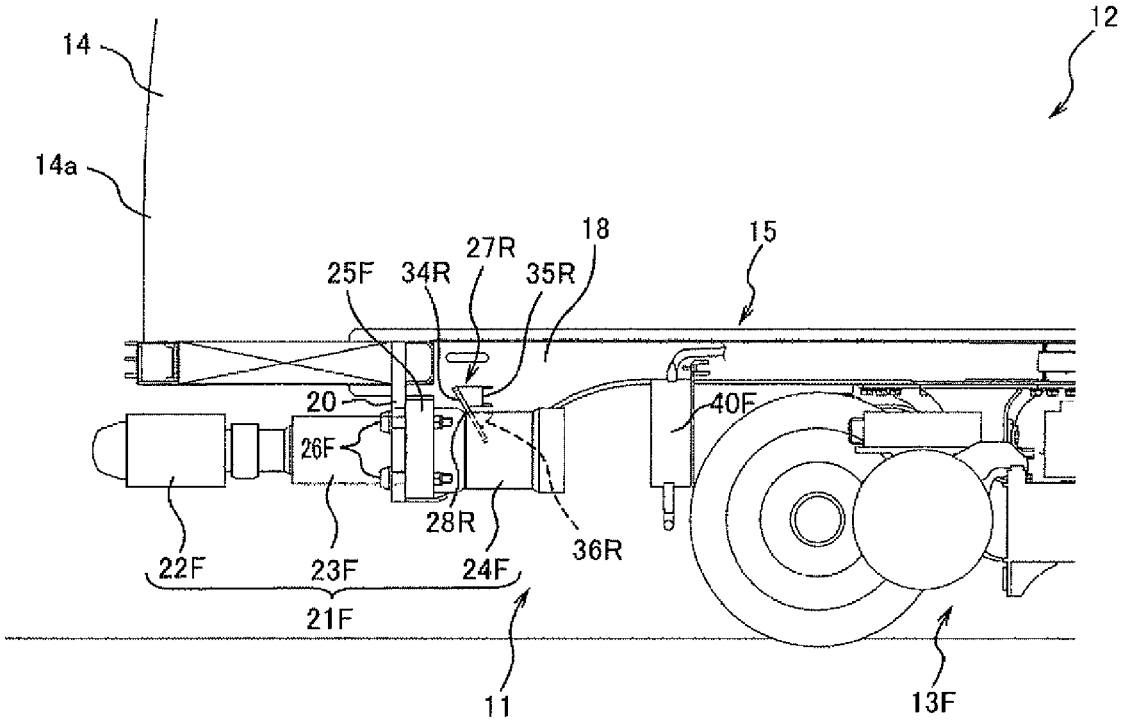
FIG. 13 is a side view showing the tail portion of the first car including the car equipment protection structure according to another embodiment of the present invention when viewed from one side.
Figure 14:
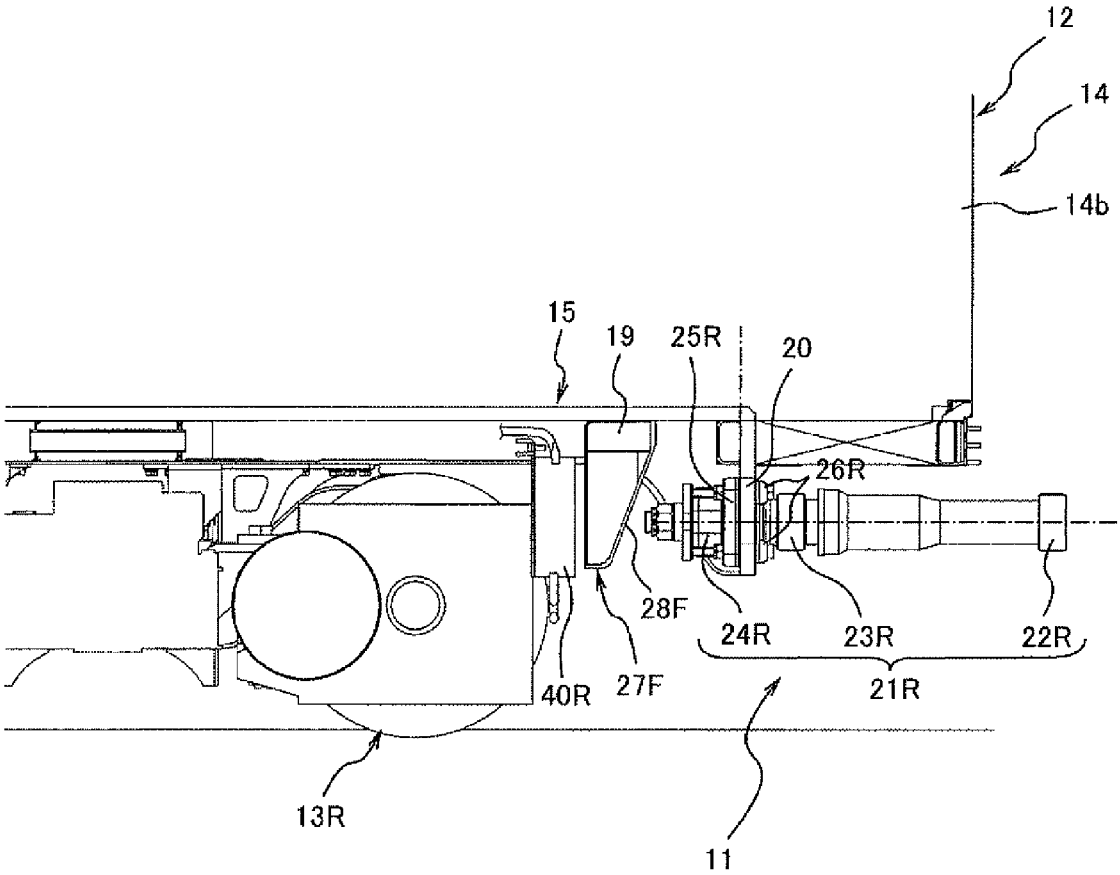
FIG. 14 is a side view showing the head portion of the first car including the car equipment protection structure according to yet another embodiment of the present invention.
Figure 15:
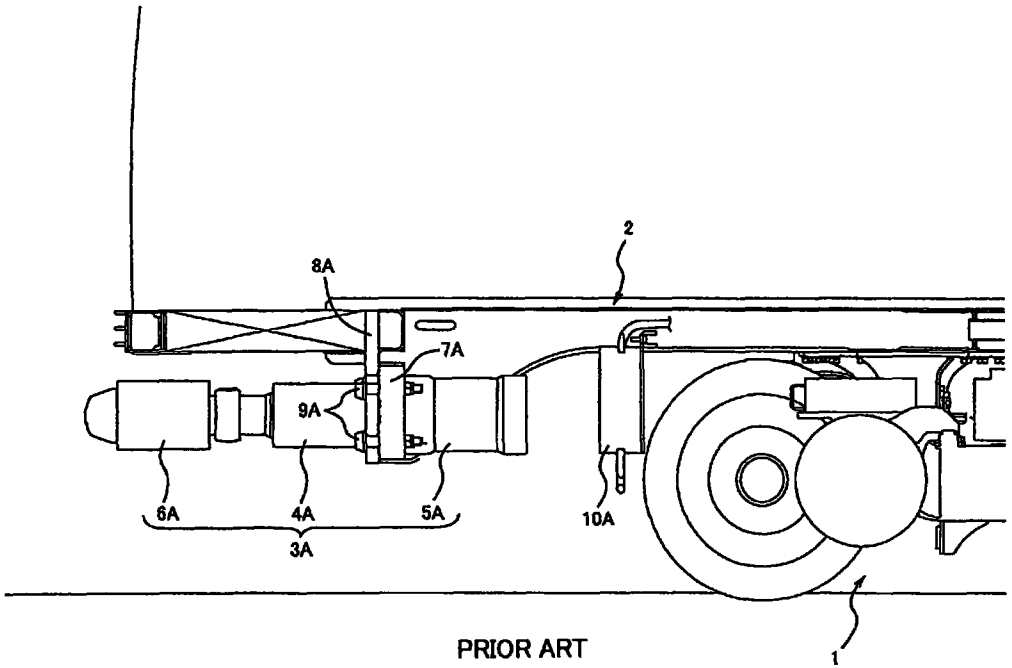
PRIOR ART Fig. 15
FIG. 15 is a side view showing the head portion of a conventional first car when viewed from one side.
Figure 16:
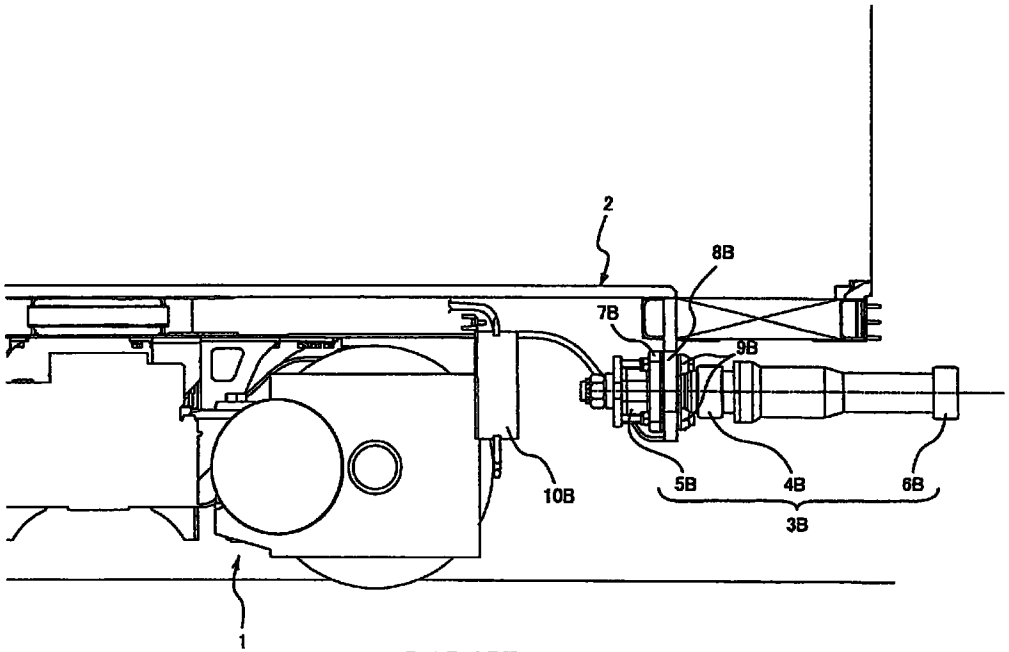
PRIOR ART Fig. 16
FIG. 16 is a side view showing the tail portion of the conventional first car when viewed from one side.

In the car equipment protection structure 11, the head-side guide member 27F is provided at the head portion of the first car 12, and the tail-side guide member 27R is provided at the tail portion of the first car 12. However, the same guide members 27F or 27R may be provided at the head portion and tail portion of the first car 12. To be specific, the tail-side guide member 27R may be provided at the head portion as shown in FIG. 13, and the head-side guide member 27F may be provided at the tail portion as shown in FIG. 14.

Moreover, the car equipment protection structure is applicable to a high-speed railcar including the first car whose head shape is a streamline shape. For example, the coupler of the high-speed railcar is provided above the underframe, and the high-speed railcar includes a space above the coupler. In this high-speed railcar, devices in the driver's cab can be protected. In this case, although each of the inclined surfaces 28F, 128F, 228F, and 28R is inclined toward the bogie 13F or 13R as it extends downward, it is inclined in the opposite direction. To be specific, each of the inclined surfaces 28F, 128F, 228F, and 28R is inclined toward the bogie 13F or 13R as it extends upward. With this, the coupler can be prevented from falling on the track while protecting the car equipment (driver's cab related device) positioned behind the coupler. The inclined surface may be inclined not only downward or upward but also obliquely upward, obliquely downward, or in the left-right direction as long as the coupler can be guided in a direction to avoid the car equipment.

Each of Embodiments 1 to 3 uses the couplers 21F and 21R each configured by arranging the oil hydraulic or gas cylinder and one of the impact absorbing pipe and the impact absorbing cushion member in series. However, the above embodiments are not limited to the couplers 21F and 21R configured as above. For example, as described in Japanese Laid-Open Patent Application Publication No. 2000-313334, the coupler configured such that a buffer device is provided behind the coupling mechanism may be applied to the above embodiments, or the coupler having an accordion structure may be applied to the above embodiments. Further, each of the couplers 21F and 21R does not have to include an impact absorbing mechanism and may be configured such that the coupling mechanism 22F or 22R is attached to a rod-shaped member.

Further, in Embodiments 1 to 3, the guide members 27F and 27R are provided directly on the pair of center sills 18 or provided indirectly on the pair of center sills 18 via the bridge member 19 extending between the pair of center sills 18. However, the positions where the guide members 27F and 27R are attached are not limited to the pair of center sills 18. The guide members 27F and 27R may be attached to the other members, such as the cross beams 17 or the other cross beams, constituting the underframe 15.

In Embodiments 1 to 3, the attachment flange portion 25F is fastened and attached to the attached flange portion 20 by the coupler attachment bolts 26F. However, the attachment flange portion 25F may be fastened and attached by rivets or may be attached by welding. A method of attaching the couplers 21F and 21R is not limited to an attachment flange method using the attachment flange portions 25F and 25R and may be a follower plate method, an anchorage method, or the like.

Moreover, each of the couplers 21F and 21R may be coupled to the underframe 15 via a coupling member (not shown), such as a tube or a chain.

As above, in the car equipment protection structure according to Embodiment 1 and the other embodiments, the inclined surface is inclined toward a railcar inner side as it extends upward or downward. Therefore, the coupler having been separated from the car at the time of collision is guided so as to avoid the car equipment and falls. With this configuration, the car equipment under the floor or in the driver's cab can be protected from the coupler having been separated by the collision. In addition, since the coupler can be prevented from falling on the track, a time necessary for the recovery work after the collision can be shortened.

Since the inclined surface of the coupler guide ember is arranged to be opposed to the end portion of the coupler, it can cause the coupler, having been separated from the car, to be guided in a direction to avoid the car equipment and fall.

In plan view, the inclined surface includes a concave portion which is concave at a car width-direction center portion and whose both width-direction side portions are inclined toward the center portion. With this configuration, the guide member can guide the coupler, which has hit the inclined surface, to the ear-width-direction center portion, and thus the separated coupler can be prevented from moving in the car width direction and being separated from the inclined surface.

Further, the underframe includes a pair of center sills extending in parallel with a car front-rear direction and a bridge member extending to connect the pair of center sills, and the coupler guide member is provided at the bridge member. In addition, the underframe includes a pair of center sills extending in parallel with a car front-rear direction, the coupler further includes an attaching portion positioned between the pair of center sills and attached to the attached portion of the underframe, the coupler guide member includes guide plate portions respectively provided on opposing surfaces of the pair of center sills, and each of the guide plate portions includes the inclined surface positioned to be opposed to the attaching portion. With this configuration, the guide member is attached to the center sill having high stiffness. With this, even if the coupler is separated from the car at the time of collision and hits the guide member, the amount of deformation of the underframe can be suppressed.

The coupler includes a cylinder and an impact absorbing member provided in series with the cylinder, the cylinder contracts when it receives a collision load, and the impact absorbing member absorbs impact energy after the cylinder has contracted. With this configuration, the collision load can be surely absorbed, the amount of deformation of each of the carbody and the underframe can be suppressed adequately, and the car equipment can be protected from the coupler having been separated from the car by the collision.

The invention claimed is:

1. A car equipment protection structure for a railcar, comprising:

an underframe;

an attached portion provided at a front-rear-direction end portion of the underframe;

a coupler attached to the attached portion and configured to be able to be coupled to another railcar;

a coupler guide member provided on a railcar inner side of the attached portion and including an inclined surface opposed to at least a part of the coupler; and railcar equipment provided on the railcar inner side of the coupler guide member, wherein the coupler and the coupler guide member are not connected to each other during the coupler being attached to the attached portion, and the coupler and the coupler guide member being configured such that, when the coupler is separated from the attached portion, the coupler guide member guides the coupler upward or downward by the inclined surface to cause the coupler to avoid the equipment.

2. The car equipment protection structure according to claim 1, wherein the inclined surface is inclined toward the railcar inner side as it extends upward or downward.

3. The car equipment protection structure according to claim 1, wherein the coupler guide member includes a guide plate portion including the inclined surface which is inclined toward the railcar inner side as the inclined surface extends upward or downward; and the inclined surface of the guide plate portion is positioned to be opposed to an end portion of the coupler.

4. The car equipment protection structure according to claim 3, wherein in plan view, the inclined surface of the guide plate portion includes a concave portion which is concave at a width-direction center portion of the railcar and whose both width-direction side portions are inclined toward the center portion.

5. The car equipment protection structure according to claim 1, wherein:

the underframe includes a pair of center sills extending in parallel with a car front-rear direction and a bridge member extending to connect the pair of center sills; and the coupler guide member is provided at the bridge member.

6. The car equipment protection structure according to claim 2, wherein:

the underframe includes a pair of center sills extending in parallel with a car front-rear direction;

the coupler further includes an attaching portion positioned between the pair of center sills and attached to the attached portion of the underframe;

the coupler guide member includes guide plate portions respectively provided on opposing surfaces of the pair of center sills; and each of the guide plate portions includes the inclined surface positioned to be opposed to the attaching portion.

7. The car equipment protection structure according to claim 1, wherein:

the coupler includes a cylinder and an impact absorbing member provided in series with the cylinder;

the cylinder contracts when it receives a collision load; and the impact absorbing member absorbs impact energy after the cylinder has contracted.

8. A car equipment protection structure for a railcar, comprising:

an underframe;

an attached portion provided at a front-rear-direction end portion of the underframe;

a coupler attached to the attached portion and configured to be able to be coupled to another railcar;

a coupler guide member provided on a railcar inner side of the attached portion and including an inclined surface opposed to at least a part of the coupler; and railcar equipment provided on the railcar inner side of the coupler guide member, wherein the coupler and the coupler guide member being configured such that, when the coupler is separated from the attached portion, the coupler guide member guides the coupler upward or downward by the inclined surface to cause the coupler to avoid the equipment, wherein the coupler guide member includes a guide plate portion including the inclined surface which is inclined toward the railcar inner side as the inclined surface extends upward or downward; and the inclined surface of the guide plate portion is positioned to be opposed to an end portion of the coupler, and wherein, in plan view, the inclined surface of the guide plate portion includes a concave portion which is concave at a width-direction center portion of the railcar and whose both width-direction side portions are inclined toward the center portion, the impact absorbing member absorbs impact energy after the cylinder has contracted.

9. A car equipment protection structure for a railcar, comprising:

an underframe;

an attached portion provided at a front-rear-direction end portion of the underframe;

a coupler attached to the attached portion and configured to be able to be coupled to another railcar;

a coupler guide member provided on a railcar inner side of the attached portion and including an inclined surface opposed to at least a part of the coupler; and railcar equipment provided on the railcar inner side of the coupler guide member, wherein the coupler and the coupler guide member being configured such that, when the coupler is separated from the attached portion, the coupler guide member guides the coupler upward or downward by the inclined surface to cause the coupler to avoid the equipment, wherein the inclined surface is inclined toward the railcar inner side as it extends upward or downward, wherein the underframe includes a pair of center sills extending in parallel with a car front-rear direction, wherein the coupler further includes an attaching portion positioned between the pair of center sills and attached to the attached portion of the underframe, wherein the coupler guide member includes guide plate portions respectively provided on opposing surfaces of the pair of center sills, and wherein each of the guide plate portions includes the inclined surface positioned to be opposed to the attaching portion.

* * * * *